US005750993A

United States Patent [19]

Bier

[11] Patent Number: 5,750,993

[45] Date of Patent: May 12, 1998

[54] METHOD OF REDUCING NOISE IN AN ION TRAP MASS SPECTROMETER COUPLED TO AN ATMOSPHERIC PRESSURE IONIZATION SOURCE

[75] Inventor: Mark E. Bier, Menlo Park, Calif.

[73] Assignee: Finnigan Corporation, San Jose, Calif.

[21] Appl. No.: 647,297

[22] Filed: May 9, 1996

[51] Int. Cl.[6] ..... H01J 49/42

[52] U.S. Cl. ..... 250/282; 250/292

[58] Field of Search ..... 250/282, 292, 250/291, 290

[56] References Cited

U.S. PATENT DOCUMENTS

| | | | |
|---|---|---|---|
| 4,535,235 | 8/1985 | McIver, Jr. | 250/282 |
| 5,157,260 | 10/1992 | Mylchreest et al. | 250/423 |
| 5,171,990 | 12/1992 | Mylchreest et al. | 250/288 |
| 5,179,278 | 1/1993 | Douglas | 250/290 |
| 5,352,892 | 10/1994 | Mordehai et al. | 250/292 |

*Primary Examiner*—Jack I. Berman
*Attorney, Agent, or Firm*—Flehr Hohbach Test Albritton & Herbert LLP

[57] ABSTRACT

A method of reducing noise due to undesolved charged droplets or charged particles in an ion trap mass spectrometer coupled to an atmospheric pressure ionization source.

3 Claims, 3 Drawing Sheets

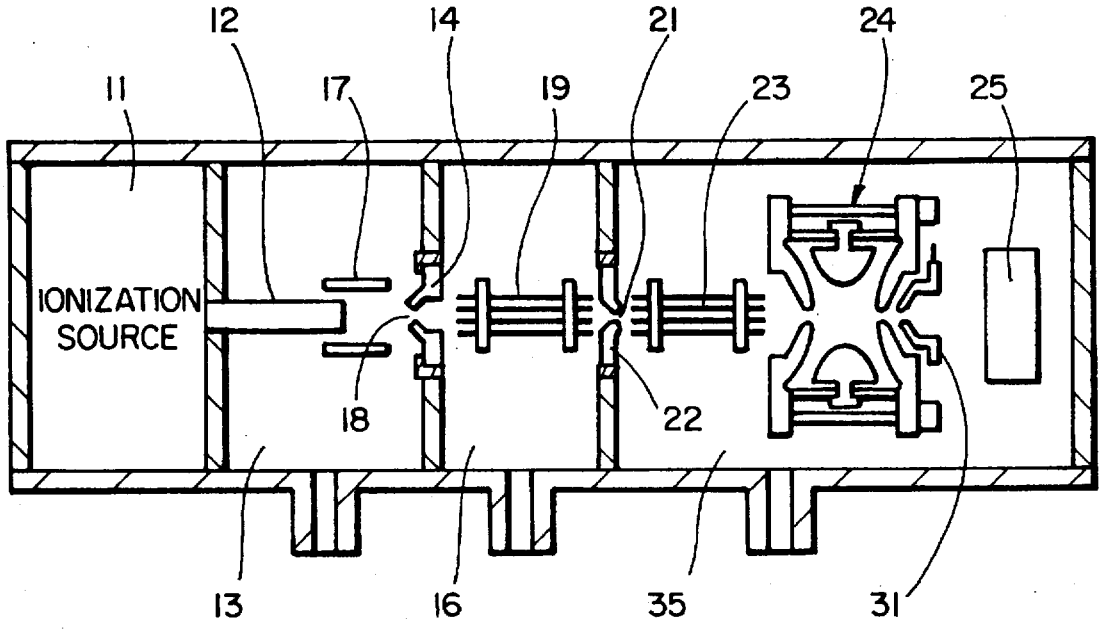
FIG_1
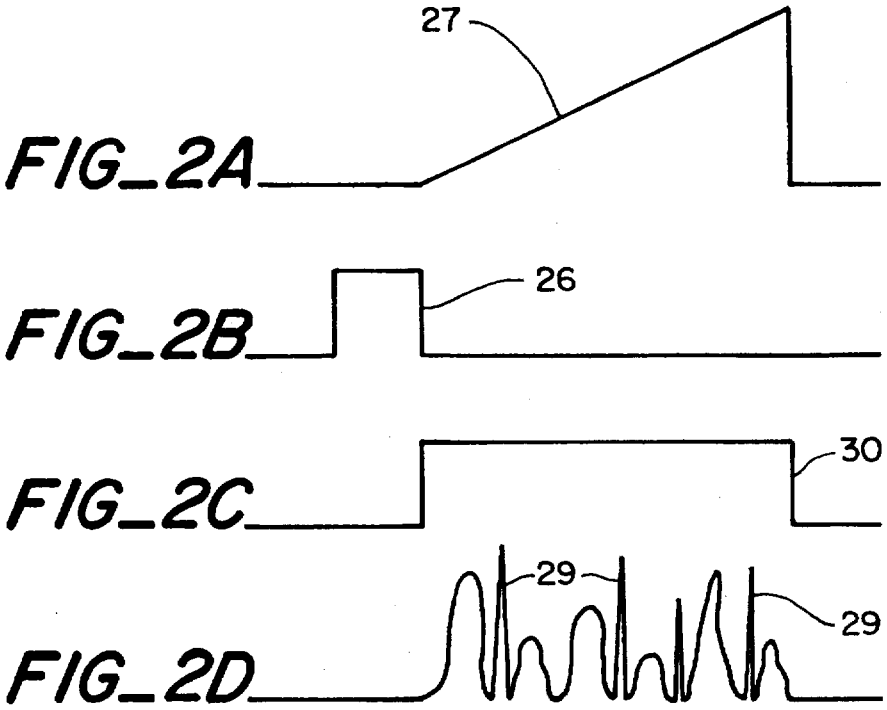

METHOD OF REDUCING NOISE IN AN ION TRAP MASS SPECTROMETER COUPLED TO AN ATMOSPHERIC PRESSURE IONIZATION SOURCE

BRIEF DESCRIPTION OF THE INVENTION

This invention relates to a method of reducing noise in an ion trap mass spectrometer coupled to an atmospheric pressure ionization source, and more particularly, a method for inhibiting transfer of charged particles to the ion trap during mass analysis.

BACKGROUND OF THE INVENTION

Atmospheric pressure ionization sources have been coupled to mass spectrometers with ion optic assemblies. U.S. Pat. No. 5,157,260 shows a quadrupole mass filter coupled to an atmospheric pressure ion source by a capillary, a conical skimmer and ion optics. A tube lens cooperates with the capillary to force the ions into the center of the ion jet which travels through the conical skimmer. Ions are continuously supplied to the mass filter by the transmission optics. The quadrupole mass filter analyzes the ion beam to provide a mass spectrum. U.S. Pat. No. 5,171,990, describes a similar arrangement in which the capillary is disposed off axis to cause undesolvated droplets from the atmospheric pressure ionization source to strike the skimmer. It is believed that the charged particles and droplets which pass through the skimmer into the lens region impinge on surfaces of the ion optics and form secondary ions and/or additional charged particles. These ions or charged particles are random and cause noise to be observed at the analyzer output. They produce noise spikes in the mass spectrum. The off axis construction has successfully increased the signal to noise ratio in a system employing a mass filter to analyze the ion beam.

When an ion trap mass spectrometer is used to analyze a beam of ions, only a predetermined number of ions are directed into the ion trap during an analyzing cycle to minimize space charge. In one embodiment, the ions are gated by applying a voltage to the tube lens of the ion optic assembly. The ion trap mass spectrometer is operated by ramping the RF voltage applied to the ring electrode to sequentially eject ions of consecutive mass. Another mode of operation is to apply an axial modulation voltage as well as a ramping RF voltage. Operation of ion trap mass spectrometers is described in U.S. Pat. Nos. 4,540,884 and 4,736,101. However, when a quadrupole ion trap is used as an analyzer in connection with an atmospheric pressure ionization source, the output is noisy due to the transmission of the charged particles directly into the ion trap during a scanning or analyzing operation. It is believed as described above that this is due to undesolvated charged droplets or particles which travels through the capillary and travel directly to the ion trap detector during analysis or impinge on surfaces of the ion optics and form secondary ions and/or charged particles which travel to the ion trap detector. This is much less likely in a linear quadrupole instrument because the particles are successfully filtered by the RF/DC quadrupoles.

OBJECTS AND SUMMARY OF THE INVENTION

It is a general object of the present invention to provide a method of minimizing the effect of charged particles in a quadrupole ion trap mass spectrometer coupled to an atmospheric pressure ionization source.

It is a further object of the present invention to provide a method of operating an ion trap mass spectrometer atmospheric pressure ionization assembly to stop the flow of charged particles into the ion trap mass spectrometer detector during analysis of the stored ions.

The foregoing and other objects of the invention are achieved by applying a blocking voltage to selected elements of the quadrupole ion trap atmospheric pressure ionizer assembly to block secondary ions and/or charged particles during an analysis cycle.

BRIEF DESCRIPTION ON THE DRAWINGS

The foregoing and other objects of the invention will be clearly understood from the following description when read in connection with the accompanying drawings of which:

FIG. 1 is a schematic diagram of an ion trap mass spectrometer system employing an ion trap mass spectrometer coupled to an atmospheric pressure ionization source by an ion optic assembly.

FIGS. 2A–2D are timing diagrams illustrating the operation of the system of FIG. 1.

DESCRIPTION OF PREFERRED EMBODIMENTS

Figure 3:
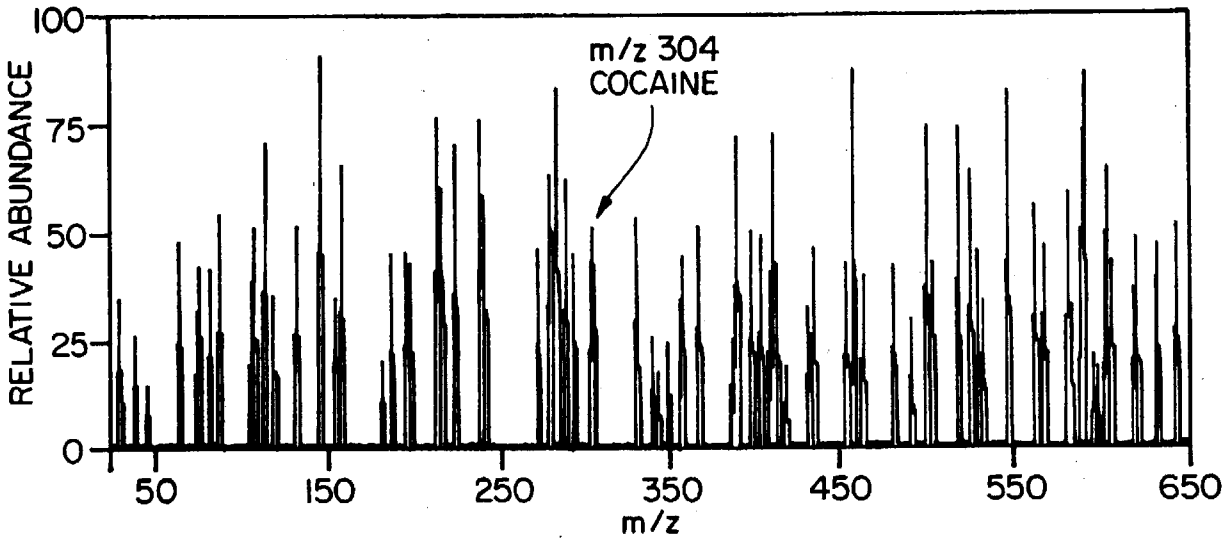
FIG. 3 shows a noisy mass spectrum of cocaine without blockage of charged particles.
Figure 4:
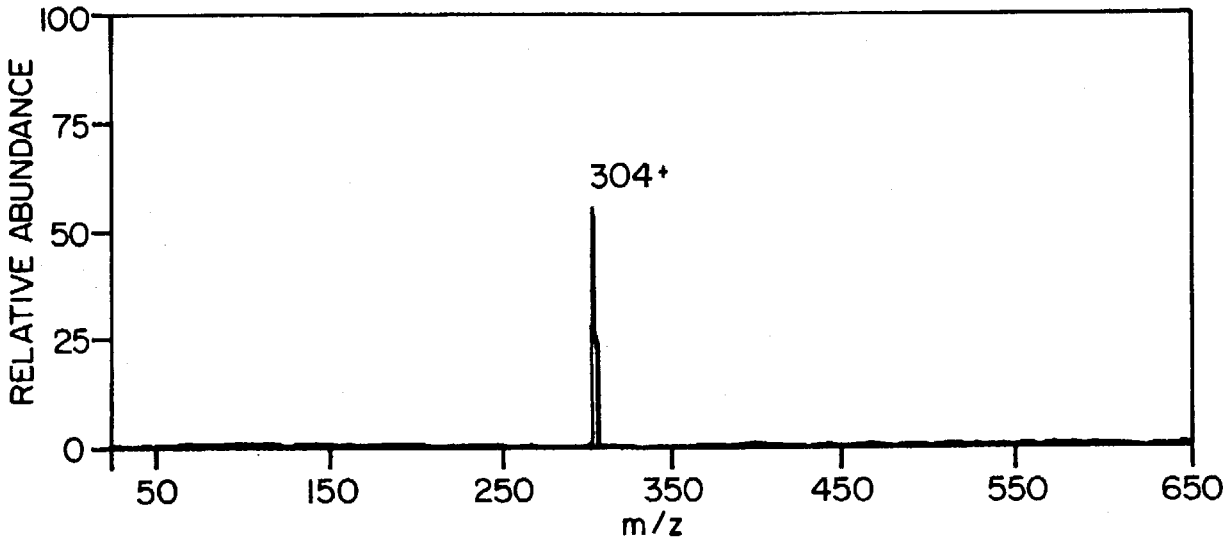
FIG. 4 shows a mass spectrum of cocaine with blockage of charged particles by applying a blocking voltage to an output lens.

Referring to FIG. 1, an atmospheric pressure ionization source 11 such as an electrospray ionization source or an atmospheric pressure chemical ionization source is shown connected to receive liquid from an associated apparatus such as a liquid chromatograph. The source 11 forms ions representative of the effluent from the liquid chromatograph. The ions are transported through a capillary 12 into a first chamber 13 which is maintained at a lower pressure (~1 TORR) than the atmospheric pressure of the ionization source 11. Due to the differences in pressure, ions and gases are caused to flow through the capillary 12 into the chamber 13. The end of the capillary is opposite skimmer 14 which separates the lower pressure region 13 from a still lower pressure region 16. A tube lens 17 surrounds the end of the capillary and provides an electrostatic field which focuses the ion beam leaving the capillary through the skimmer aperture 18. The operation of the tube lens is described in U.S. Pat. No. 5,157,260 which is incorporated herein by reference. A multi-pole ion guide such as octopole 19 has RF applied thereto and acts to transmit ions from the skimmer 14 through aperture 21 formed in the interoctopole lens 22. Ions traveling through the aperture 21 are directed by a second RF operated multi-pole ion guide such as octopole 23 into the ion trap 24. The ions are ejected from the ion trap mass spectrometer and are detected in detector 25 whose output can be displayed as a mass spectrum.

As described above, it is believed that undesolvated charged droplets or particles flow through the capillary and acquire kinetic energy which allows them to pass through the skimmer orifice into the region 16 where they may impact upon the surface of the octopole creating secondary ions or charged particles or pass directly through the interoctopole lens. These charged particles are random and travel through the quadrupole ion trap to the detector. Charged particle noise appears at the detector output thereby decreasing the signal to noise level by and producing unfiltered spikes in the mass spectrum.

In the present invention, the tube lens 17 is used as an ion gate whereby ions are only allowed to travel through the transmission octopoles for a predetermined time whereby to introduce into the ion trap a controlled number of ions to thereby prevent saturation of the ion trap. The tube lens is typically at a negative voltage (for example, ca—200 volts DC) for positive ions. This defocuses the ion stream preventing the ions from entering the skimmer. A positive DC voltage pulse 26, for example 20 volts, applied to the tube lens, FIG. 2B, allows ions to pass through the skimmer and into the ion trap. The problem is that noise particles are not blocked by the tube lens. After the introduction of ions into the ion trap, the RF voltage applied to the quadrupole ion trap is ramped as shown at 27, FIG. 2A. The output of the detector 25, FIG. 2D, is the mass spectrum of the trapped ions. However, as explained above, charged particles formed in the system find their way into the detector and cause noise spikes 29 in the output. In accordance with the present invention, a high DC voltage 30, FIG. 2C, for example 300 volts, can be applied to either octopole 19, inter-octopole lens 22, octopole 23 or ion trap output lens 31 to block the passage of charged particles into the detector 25 during analysis of the trapped ions. The particles can also be blocked by applying a low RF voltage to the octopoles by inhibiting transmission of particles to the ion trap. The interoctopole lens 22 can be used to block charged particles is one preferred method. The lens 22 transfers ions from octopole 19 to octopole 23, provides a pumping barrier between the lower pressure region 16 and low pressure region 25 and serve as a potential barrier to charged particles.

Figure 5:
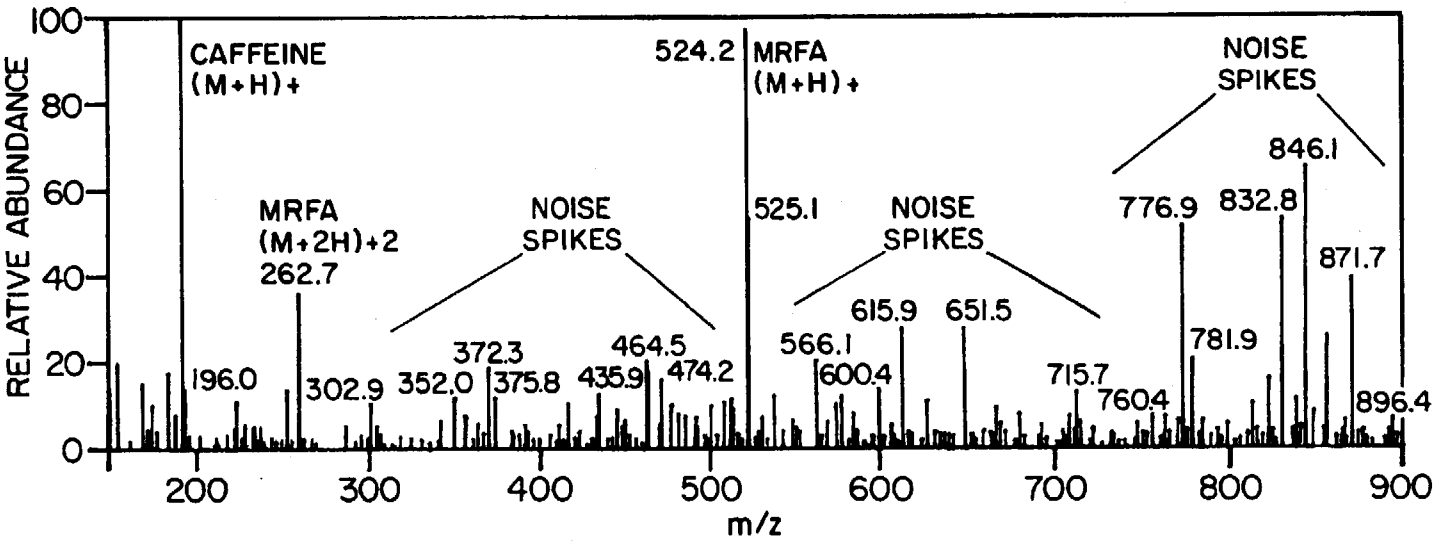
FIG. 5 shows the noisy mass spectrum of caffeine and a tetrapeptide without blockage of charged particles.
Figure 6:
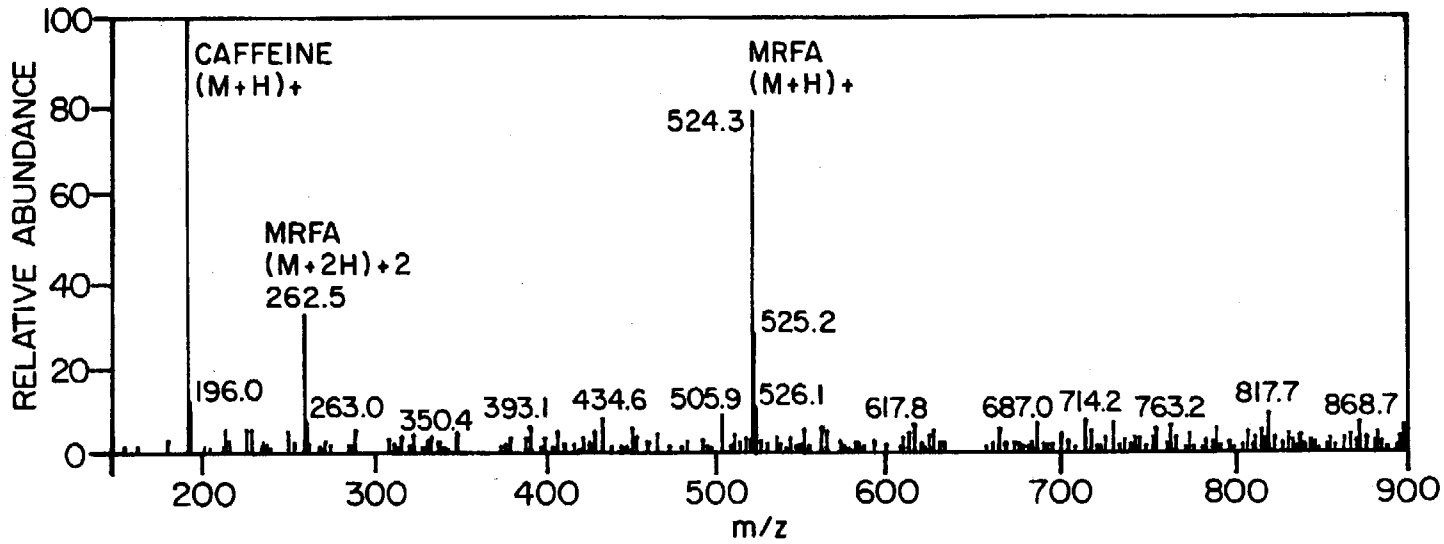
FIG. 6 shows the mass spectrum of caffeine and a tetrapeptide with blockage of charged particles.

The ion trap mass spectrometer-atmospheric pressure ionization system of FIG. 1 was operated to obtain the mass spectrum of cocaine and charged particle noise with RF applied to the octopoles and the output lens at 0 volts DC. The mass spectrum is shown in FIG. 3. The system was then operated with the output lens at +300 volts DC. The mass spectrum is shown in FIG. 5. Clearly the charged particle noise has been reduced. The disadvantage with using the output lens to block particle noise is that it inhibits the transmission of low mass ions with smaller kinetic energies from the ion trap to the detector. It is preferred to use the interoctopole lens 22 as the noise gate. FIG. 6 shows the mass spectrum of caffeine (m/z 194.1) and a tetrapeptide MRFA (Met-Arg-Phe-Ala) (m/z 524.3) using the interoctopole gate biased at +298 volts DC. This also shows an improvement in the signal to noise ratio.

What is claimed:

1. A method of operating and reducing noise in the output of an ion trap mass spectrometer including an output lens and a detector for providing said output, said mass spectrometer coupled to an atmospheric pressure ionization source by a capillary tube which transfer ions from the atmospheric pressure ionization source to a lower pressure chamber, a skimmer separating said lower pressure chamber from a low pressure chamber, a tube lens surrounding such capillary tube and focusing the ion beam leaving said capillary through said skimmer, an aperture lens spaced from said skimmer to define a low pressure chamber, a multipole ion guide in said low pressure chamber for guiding said ion beam from said skimmer to said aperture lens, a low pressure chamber housing said ion trap mass spectrometer and a multipole ion guide for guiding the beam from said aperture into said ion trap, the method comprising:

applying a DC voltage to said tube lens to block ions until a transmitting voltage of predetermined duration is applied to gate a predetermined number of ions into the ion trap;

applying a ramped RF voltage to said ion trap to eject ions from said ion trap into said detector provide a mass spectrum; and, blocking the passage of particles into said detector during the analysis phase by applying a blocking or filter voltage to any one of said multipole ion guides, inter-multipole lens or output lens.

2. The method of claim 1 in which a high DC voltage is applied to any one of said multipole ion guides, inter-multipole lens or output lens.

3. The method of claim 1 in which the RF voltage applied to the multipole ion guides is reduced to zero.

* * * * *